US006065176A

United States Patent [19]

Watanabe et al.

[11] Patent Number: 6,065,176

[45] Date of Patent: May 23, 2000

[54] TOOTHBRUSH

[76] Inventors: Takayuki Watanabe, 9-6, Shoubuzawa, Odakura, Nishigou-mura 961; Hisakata Hoshizaki, 1, Meotozaka, Ohkanbara, Sukagawa-shi 962, both of Japan

[21] Appl. No.: 09/261,663

[22] Filed: Mar. 3, 1999

Related U.S. Application Data

[63] Continuation of application No. 09/030,556, Feb. 25, 1998, abandoned.

[30] Foreign Application Priority Data

Feb. 29, 1996 [JP] Japan ..... 8-67383

[51] Int. Cl.[7] ..... A46B 9/04

[52] U.S. Cl. ..... 15/167.1; D15/207.2; D15/DIG. 5

[58] Field of Search ..... 15/167.1, 207.2, 15/DIG. 5

[56] References Cited

U.S. PATENT DOCUMENTS

| | | | |
|---|---|---|---|
| 669,402 | 3/1901 | Rose | 15/167.1 |
| 1,018,927 | 2/1912 | Sarrazin | 15/167.1 |
| 1,456,535 | 5/1923 | Cartwright | 15/167.1 |
| 3,188,673 | 6/1965 | Newman | 15/167.1 |
| 4,031,587 | 6/1977 | Dietrich | 15/167.1 |
| 4,617,694 | 10/1986 | Bori | 15/207.2 |
| 5,305,489 | 4/1994 | Lage | 15/207.2 |
| 5,396,678 | 3/1995 | Bredall | 15/167.1 |
| 5,459,898 | 10/1995 | Bacolot | 15/167.1 |
| 5,511,275 | 4/1996 | Volpenhein | 15/167.1 |
| 5,613,262 | 3/1997 | Choy-Maldonado | 15/207.2 |

*Primary Examiner*—Randall E. Chin

[57] ABSTRACT

A toothbrush is provided that can easily and effectively remove dental plaque on molars in the deepest part of the mouth, in interdental spaces and on inner surfaces of teeth. The bristle tips form three brush surfaces. The first brush surfaces adjacent the free end of the brush extends upwardly from the free end to define a first bristle peak. The second brush surface extends downwardly from the first bristle peak toward the brush head. The third brush surface extends upwardly from the second brush surface to a second bristle peak adjacent to the attached end of the brush head. The second brush surface and the third brush surface intersect to form a bristle valley located below said first bristle peak and the second bristle peak. The toothbrush preferably comprises six to ten rows of bristle tufts.

26 Claims, 5 Drawing Sheets

TOOTHBRUSH

This application is a continuation of U.S. application Ser. No. 09/030,556, filed Feb. 25, 1998, now abandoned.

TECHNICAL FIELD OF THE INVENTION

This invention relates to a toothbrush, in particular to a toothbrush which can effectively and easily remove dental plaque from the teeth, especially from molars, and from the interdental spaces between the teeth.

BACKGROUND OF THE INVENTION

According to research on dental diseases by the Ministry of Health and Welfare in Japan in 1993, the average life of a second molar is 45.8 years, that is, the second molar is lost 10.5 years earlier than other teeth which have an average life of 56.3 years. It is now a matter of common knowledge that the main reasons for losing teeth are dental caries and periodontal disease. It is said that dental caries and periodontal disease are caused mainly by dental plaque that forms on the surfaces of teeth. Daily brushing plays a major role in preventing the accumulation of plaque and the occurrence of dental diseases caused by such plaque. Periodic care by dental professionals also plays a significant role in preventing dental disease. One of the main methods for controlling plaque is brushing with a toothbrush, and a variety of different types of toothbrushes have been developed for this purpose.

It has been proposed heretofore to reduce the size of the brush head of the toothbrush in order to more easily reach the second molars. When the body of the brush head is made smaller, the number of bristles must be correspondingly reduced compared to the number of bristles used in a conventional full-sized brush head. During brushing, the reduced number of bristles bears the same amount of pressure as that applied to the larger number of bristles found in conventional toothbrushes. This tends to cause increased bristle bending and shortens the useful life of the toothbrush.

Japanese Laid-open Patent Application Hei 5-168528 (168528/93) discloses a toothbrush which has two sections of bristles, the bristles of one section being longer than the bristles of the other section. While such a toothbrush may be more efficient in removing dental plaque from molars, it is less efficient in removing dental plaque from the other teeth. The presence of unremoved dental plaque from the other teeth can lead to dental diseases such as caries and periodontal disease.

On the other hand, it is easy to brush the flat surfaces of the teeth with conventional toothbrushes having uniform bristle length, but, since the sizes of the interdental spaces vary according to their positions in the mouth, such brushes do not effectively clean the interdental spaces between the teeth.

SUMMARY OF THE INVENTION

The present invention provides a toothbrush which can easily and effectively remove dental plaque from molars in the deepest part in the mouth, from the surfaces of the other teeth and from the interdental spaces. This is accomplished by providing a toothbrush whose brush head comprises three bristle surfaces, none of which bristle surfaces are parallel with respect to the surface of the brush head from which the bristles extend.

In accordance with one aspect of the present invention there is provided a toothbrush comprising a brush head, a handle, and a neck portion connecting said brush head to said handle; p1 said brush head comprising a plurality of rows of bristle tufts, each of said rows of bristle tufts being oriented in a direction generally perpendicular to the longitudinal axis of said toothbrush;

the tips of the bristles of said bristle tufts being arranged to provide three brush surfaces;

the first of said three brush surfaces being located adjacent the free end of said brush head and extending upwardly from said free end at an angle of from about 15° to about 45° with respect to said brush head to define a first bristle peak;

said second brush surface extending downwardly from said first bristle peak toward said brush head at an angle of from about 15° to about 45° with respect to said brush head;

said third brush surface extending upwardly from said second brush surface, at an angle of from about 5° to about 25° with respect to said brush head, to a second bristle peak, said second brush surface and said third brush surface forming a bristle valley or bottom located below said first bristle peak and said second bristle peak, the ratio of the height of the bristles at said first bristle peak to the height of the bristles located at said bristle valley being from about 1.1 to about 1.4;

the difference between the height of the bristles at said second bristle peak and the height of said bristles at said first peak being less than about 2 mm.

It will be understood that the aforementioned rows of bristle tufts may be either linear or arcuate in configuration.

In a preferred embodiment, the brush head comprises six to ten rows of bristle tufts.

In an even more preferred embodiment, the toothbrush of the invention comprises six to ten rows of bristle tufts, with said first bristle peak being located at the top of the second or third row of bristle tufts and said bristle valley being located at the third to fifth rows of bristle tufts.

DETAILED DESCRIPTION OF THE INVENTION

Bristles which are useful in the manufacture of toothbrushes of the present invention can be made from synthetic resins such as polybutylene terephthalate (PBT), polyethylene terephthalate (PET), polyamide, polypropylene, polyvinyl chloride (PVC), polyvinylidene chloride, polyurethane, and mixtures thereof, animal hair such as pig hair, or any other materials known in the art for this purpose. In order to attain the aim of the present invention to improve dental plaque removability, especially on molars, comparatively stiff filaments, such as polybutylene terephthalate (PBT) filaments are preferred. The thickness of the filament in the case of polybutylene terephthalate is preferably from about 0.15 mm to about 0.3 mm. If the filament thickness is less than about 0.15 mm, the filament may not have sufficient bending strength. If the filament thickness is greater than 0.3 mm, the filament may be too stiff.

In the toothbrush of the present invention, the material of the brush head, neck and handle is not particularly restricted. Any materials known in the art for use in the manufacture of conventional toothbrushes can be used. Such materials include acrylonitrile-styrene copolymer (AS); acrylonitrile-butadiene-styrene copolymer (ABS); polypropylene (PP); cellulose derivatives such as cellulose propionate; polyamide; polycarbonate-polyethylene terephthalate copolymer (PC-PET); polycarbonate-acrylonitrile-butadiene-styrene copolymer (PC-ABS); polymethyl pentene; acrylic polymers such as polymethyl methacrylate (PMMA); polyacetal resins; thermoplastic elastomers (olefinic polymers, styrenic polymers, polyesters, polyurethanes, PVC polymers, etc.) and the like.

In the toothbrush of the present invention, the brush head includes a brush head body and a plurality of rows of bristle tufts embedded in tuft holes formed in said body. The toothbrush of the present invention has a handle for holding the brush when users brush their teeth. There is a neck portion which joins the brush head and the handle. The width of the neck is preferably less than the width of the brush head and the handle, thereby imparting to the toothbrush a certain degree of flexibility and making the toothbrush easier to handle.

The brush head of the present invention preferably comprises six to ten rows of bristle tufts, each of which rows is oriented in a direction generally perpendicular to the longitudinal axis of the toothbrush. If the brush head has less than six rows of bristles, it is difficult to provide a brush head of sufficient length for effective removal of dental plaque. If the brush has more than ten rows of bristles, the brush section becomes too long to effectively brush the molars and ease of use decreases.

In the toothbrush of the present invention, it is preferred that the first row and the second row of bristle tufts closest to the free end of the brush head are made up of two and three tufts of bristles respectively, and the other rows (i.e., the third row to the last row at the end of the brush head body nearest the neck of the toothbrush) are made up of four tufts of bristles arranged in similar linear or arcuate configuration and are placed symmetrically with respect to the center line of the brush in the longitudinal direction. Such an arrangement of the bristle tufts makes the brush end of the toothbrush thin. The term "brush end", which is also sometimes called the "free end" of the brush head, refers to the end of the toothbrush opposite the handle of the toothbrush.

In the present invention, the tips of the bristles on the bristle tufts on the brush head must be arranged, as by cutting, so that the resulting brush surfaces define three planes. By cutting the bristle tips, the shape of the brush surface characteristic of the present invention can be easily formed. The three brush surfaces are made continuing in the longitudinal direction of the brush head.

The first brush surface is located adjacent the free end of the brush head. The bristles at the brush end are short and the bristles become longer toward the handle. The first brush surface forms an angle of from about 15° to about 45° to the brush head. The bristles form a first bristle peak, preferably at the second row or the third row of bristles from the brush end. If the first brush surface angle is less than about 15°, sufficient dental plaque removal from molars may not be attained. If the angle of the first brush surface is greater than about 45°, fitting of the toothbrush to the interdental spaces, especially between molars, decreases. In a toothbrush having a compact brush head, the aforementioned first bristle peak must be at the second row or the third row of bristles from the brush end. If the first bristle peak is in the first row, it is hard to provide the first brush surface. If it is in the fourth row or beyond, dental plaque removability on molars decreases because the first bristle peak is too near to the center of the brush head.

The second brush surface extends from the first peak defined by the first brush surface and declines toward the handle at an angle of about 15° to about 45°, and defines a bottom between the third row of bristles and fifth row of bristles from the brush end. It will be understood that the first brush surface joins or meets the second brush surface at said first peak. This arrangement improves fitting of the brush to interdental spaces so as to remove dental plaque efficiently.

The third brush surface extends upwardly from the aforementioned bristle valley or bottom to a second bristle peak. Bristles of the third brush surface become longer from the bristle valley as they approach the second bristle peak, becoming longest at the aforementioned second peak. The third brush surface forms an angle of about 5° to about 25° with respect to the surface of the brush head body. Consequently the third brush surface continuously ascends from the aforementioned bottom point to the second bristle peak. Each of the three brush surfaces can be a flat surface or a curved surface, and in the case of the curved surface, the second brush surface and the third brush surface can have continuous curvatures. The term "bristle valley" or "bristle bottom" refers to that part of the brush where the first brush surface meets the second brush surface. All of the tips of the bristles in at least one of the second brush surface and the third brush surface form a plane.

Any cross section of the brush surfaces to the transverse direction of the brush is preferably a straight line parallel to the block head or an arc.

The ratio of the height of the bristles at the first bristle peak E to the height of the bristles at bottom point F must be 1.1 to 1.4.

In the present invention, the difference in the height of the bristles at the first bristle peak and the height of the bristles at the second bristle peak is less than about 2 mm. Preferably, the bristles at the first bristle peak and the bristles at the second bristle peak have the same height. The difference in height between bristles of the first and second bristle peaks and the height of the bristles at the bottom point is preferably between about 0.3 mm to about 6 mm, more preferably between about 1.5 mm to about 3 mm. If less than about 0.3 mm, plaque removal from the molars in the deepest part of the mouth is insufficient. If more than 6 mm, it is hard for bristles to contact every surface of the other teeth, and plaque removal from the other teeth is insufficient.

In the present invention, it is preferred to use stiffer bristles for the first and second or first to third rows of bristles. Similarly, it is preferred to use stiffer bristles for the last row of bristles from the brush end, i.e., the row of bristles nearest to the neck of the toothbrush. Bristle stiffness may be controlled by using stiffer materials or thicker bristles or both. This stiffening of specific bristles improves removal of plaque and also prevents the spread of bristle tips during use. Though the bristles between the first row and the second or third row have the same thickness, the last row of bristles from the bristle end included in the third brush surface can have a different thickness.

Further it is preferred to use one color for the stiff or thick bristles and another color for the other bristles. The different colors make the toothbrush colorful as well as aesthetically appealing, and also draws attention to the spread of bristle tips after a period of use. The diameter of the thick bristles is preferably 5% to 30% greater than that of the other bristles.

For the toothbrush of the present invention, it is preferable that the first brush surface and the second brush surface are symmetrically disposed about a plane which bisects the first peak and which is transverse to the brush head. This is accomplished when the angle of the first brush surface with respect to the brush head is equal to the angle of the second brush surface with respect to the brush head.

Further, it is preferable that the length (C in FIG. 1) of the third brush surface in the longitudinal direction of the brush head be longer than one half of the entire bristle section length (D in FIG. 1).

The toothbrush of the present invention may be produced by known methods using conventional high speed toothbrush manufacturing machines such as the Sabolanski ZT1-TC machine (Sabolanski Co. LTD). The toothbrush of the present invention can easily and effectively remove dental plaque on molars in the deepest part of the mouth, in interdental spaces, on the inner surfaces of teeth, etc. by providing the aforementioned three brush surfaces.

EXAMPLES

The invention will be more clearly understood with reference to the following examples.

Toothbrush blanks in the shape of FIG. 6, and comprising a brush head, a neck and a handle were manufactured by injection molding a blend of polypropylene and EPDM. Measurements of the toothbrush blanks were as follows: the whole length L: 188 mm; the brush head length G: 24.4 mm; the brush head width H: 11.3 mm; the maximum width, I, of the handle: 14 mm; neck portion width J: 5 mm; and neck portion thickness K: 5.5 mm. A toothbrush in accordance with the present invention was produced by embedding polybutylene terephthalate filaments of 0.2 mm in diameter in the brush head portion of the toothbrush blank.

Referring now to FIG. 1, there is shown therein a side view of the brush head portion of a toothbrush according to the present invention. In FIG. 1, numerals 1, 2 and 3 indicate the first, second and third brush surfaces, respectively, formed for example by suitably cutting bristle tips. In this example, the three brush surfaces are all in the form of flat planes. The length, A, from the brush end 20 to the first bristle peak 6 is 3.3 mm; the length, B, from the first bristle peak to the bottom point 22 is 4.1 mm; and length, D, of the bristle section is 19.9 mm. The height, E, of the bristles at the first bristle peak 6 is 11.0 mm. The height, F, of the bristles at bottom point 22, where second brush surface 2 meets third brush surface 3, is 9.0 mm.

FIG. 2 is a plan view of the brush section shown in FIG. 1. The first row 25 of bristles is located adjacent the brush end 40 and consists of two bristle tufts 25*a*. The second row 26 of bristles consists of three bristle tufts 26*a* and is slightly arcuate in configuration. Each of third row 27 of bristles, fourth row 28 of bristles, fifth row 29 of bristles, sixth row 30 of bristles, seventh row 31 of bristles, and eighth row 32 of bristles consists of four bristle tufts. As can be seen in FIG. 2, all of rows 27–32 have a somewhat arcuate configuration. The bristles comprising the bristle tufts are made of polybutylene terephthalate. The bristles in first row 25, second row 26, third row 27 and eighth row 32 are stiffened by using bristles having a larger diameter than those of the other bristles. The diameter of the individual bristles in the bristle tufts in bristle rows 25, 26 and 27, indicated in FIG. 2 by circles with slanting lines, is 0.2 mm. The diameter of the individual bristles comprising bristle tufts 5 in bristle row 32, also denoted by circles with slanting lines, is 0.23 mm. The diameter of the individual bristles comprising the bristle tufts in bristle rows 28–31 is 0.17 mm. As is clear from FIGS. 1 and 2, the bristles are cut so that the first bristle peak 6 is located in the second row from the brush end. The bottom point 22 is located in the third to fourth row from the brush end 40.

First brush surface 1, which is adjacent to brush end 40, is oriented at an angle of about 31° with respect to the brush head. Third brush surface 3, which is nearest to brush neck 12, is oriented at an angle of about 9° with respect to the brush head. Second brush surface 2, which is intermediate the first and third brush surfaces, is oriented at an angle of about 26° with respect to the brush head. The ratio of the bristle height, E, at peak 6 to the bristle height, F, at bristle valley 22 is $^{11}/_{9}$=1.22. The length, C, measured parallel to the brush head, of the third brush surface, is more than one half of the bristle section length, D, also measured parallel to the brush head.

FIG. 3 shows a side view of another embodiment of a toothbrush of the present invention in which brush surfaces 1, 2 and 3 are somewhat curved.

General views of other toothbrushes according to the present invention are shown in FIGS. 7 and 8, in which the left side view is symmetrical with the right side view.

For people who have wisdom teeth, the third permanent molars, the toothbrush of the present invention provides an effective means for brushing the wisdom teeth by the presence of the first bristle peak. FIG. 4 shows the conformance of bristles to the surfaces of the third molar as a result of the geometrical features of the toothbrush of the present invention.

The spreading of bristle tips of the first bristle peak 6 following use can be prevented effectively when the bristles at said peak have increased diameters or are made from stiffer materials. Further, by the presence of said first bristle peak 6, the toothbrush of the present invention can brush maloccluded teeth more effectively than conventional toothbrushes with flat brush surfaces because the present toothbrush can easily reach any surface of maloccluded teeth which are not properly aligned. FIG. 5 shows the conformance of bristles of the first and second brush surfaces to interdental spaces for the toothbrush of the present invention. FIG. 5 illustrates that the toothbrush can easily contact and effectively brush the internal interdental spaces of maloccluded incisors.

The toothbrush of the present invention is also especially effective for brushing the internal surfaces of incisors, i.e., the surfaces of the teeth facing the tongue. When held parallel to the dentition, the toothbrush of the present invention contacts the internal surfaces of the incisors with the bristles of at the second bristle peak, which effectively permits the removal of dental plaque from these surfaces.

EFFECTS OF THE INVENTION

As the human dentition exhibits a bow-shaped curvature, not all of the bristles of conventional toothbrushes with flat brush surfaces contact the teeth during brushing, and brushing is apt to be carried out by only a specific portion of the bristle assembly. This leads to uneven wear of the brush with concomitant shortening of its useful life. Also, selected tooth surfaces are not effectively contacted by conventional toothbrushes, and, therefore, these surfaces are not effectively brushed. In the toothbrush of the present invention, the provision of three brush surfaces and the geometrical and physical features of the brush surfaces and bristles as herein described improves the fit of the bristles to the dentition, increases the effectiveness of brushing and prevents undesirable spreading and wear of bristle tips during use.

BRIEF DESCRIPTION OF THE DRAWINGS

FIG. 6(*b*) is a plan view of the toothbrush blank of FIG. 6(*a*);

FIG. 7(*b*) is a side view of the toothbrush of FIG. 7(*a*);

FIG. 7(*c*) is a rear view of the toothbrush of FIG. 7(*a*);

FIG. 8(*b*) is a rear elevational view of the toothbrush of FIG. 7(*a*);

FIG. 8(*c*) is a partial cross-sectional view taken along line P—P of FIG. 7(*a*);

FIG. 8(*d*) is a cross-sectional view taken along line Q—Q of FIG. 7(*b*); and FIG. 8(*e*) is a cross-sectional view taken along line R—R of FIG. 7(*b*).

DESCRIPTION OF SYMBOLS

Figure 1:
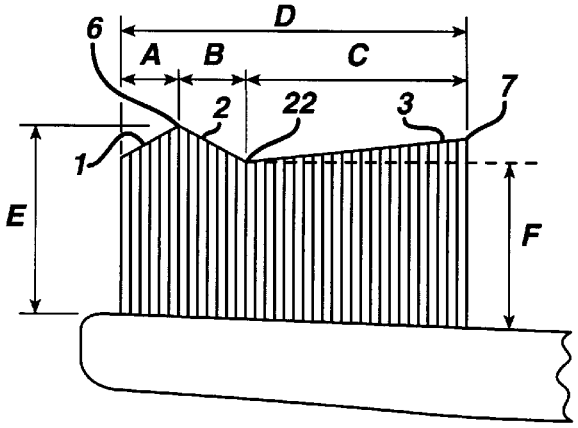
FIG. 1 is a side view of the brush head of a toothbrush in accordance with the present invention.
Figure 2:
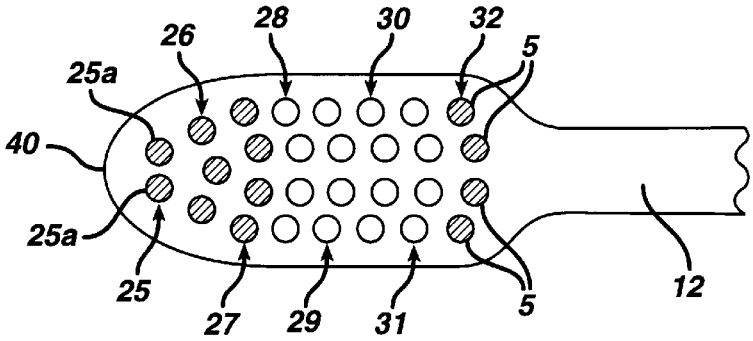
FIG. 2 is a plan view of the toothbrush of FIG. 1 showing the rows of bristles.
Figure 3:
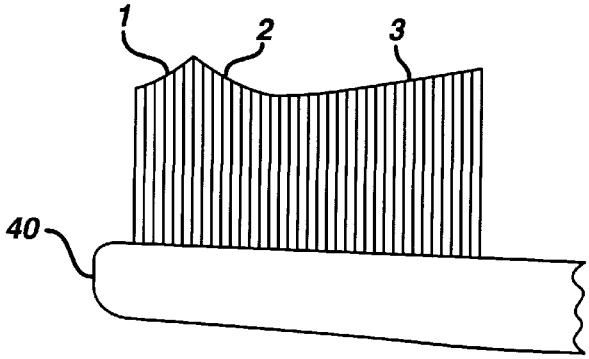
FIG. 3 is a side view of a brush head of another embodiment of a toothbrush according to the present invention, the brush surfaces being curved.
Figure 4:
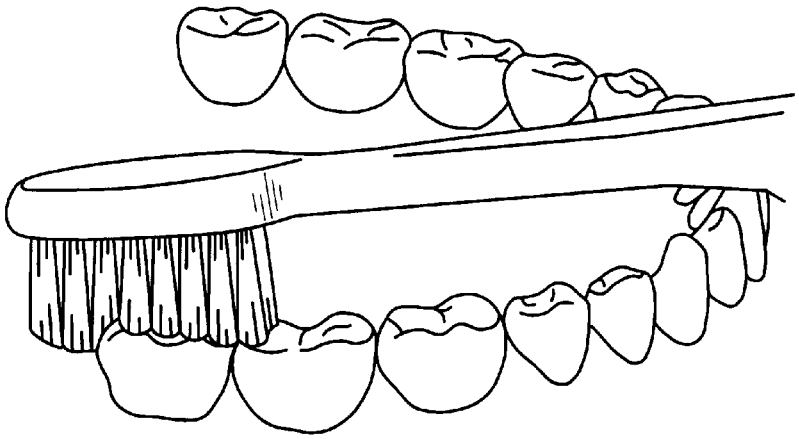
FIG. 4 is a view of the toothbrush of FIG. 1 when being used in the brushing of molars.
Figure 5:
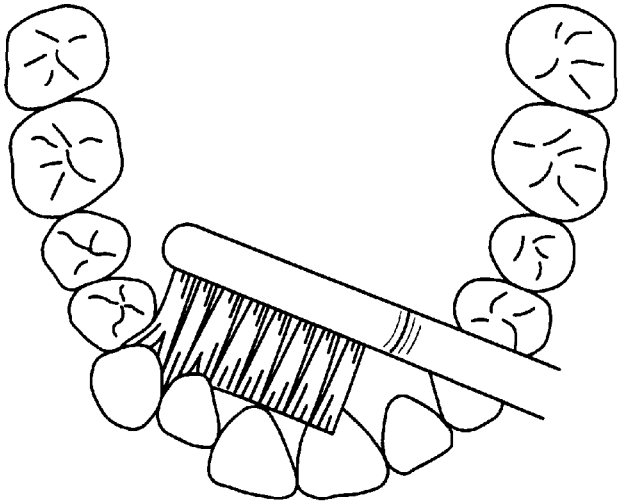
FIG. 5 is a view of the toothbrush of FIG. 1 when being used in the brushing of maloccluded teeth.
Figure 6A:
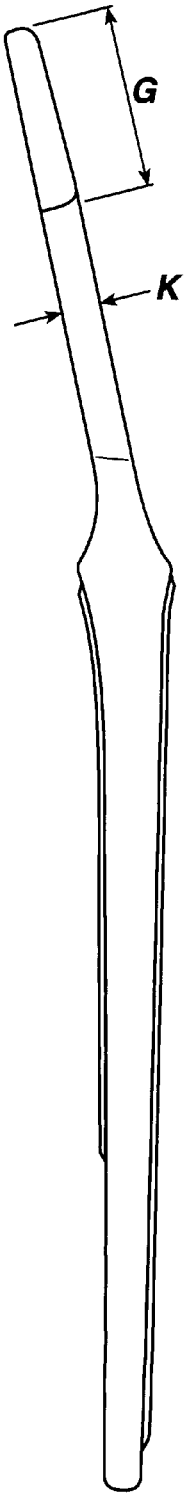
FIG. 6(*a*) is a side view of a toothbrush blank of the present invention.
Figure 6B:
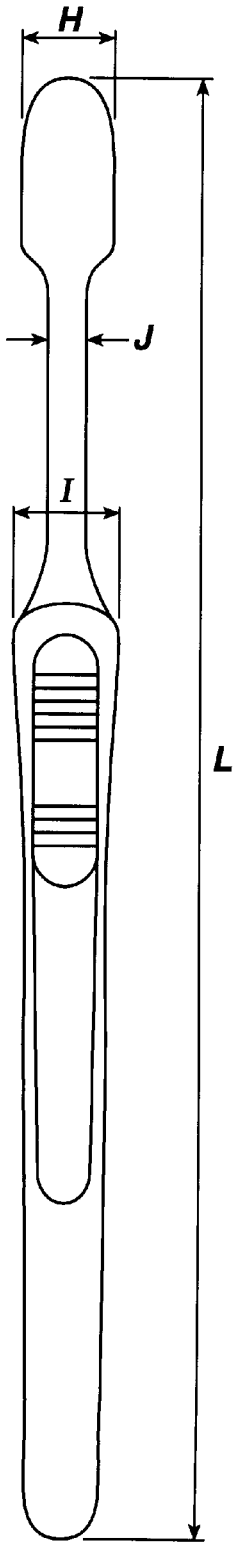
Figure 7A:
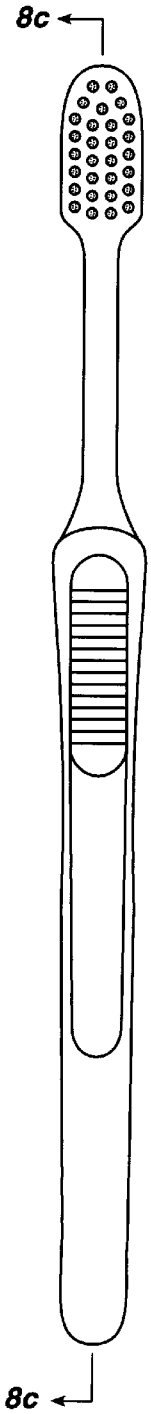
FIG. 7(*a*) is a front view of another embodiment of a toothbrush of the present invention.
Figure 7B:
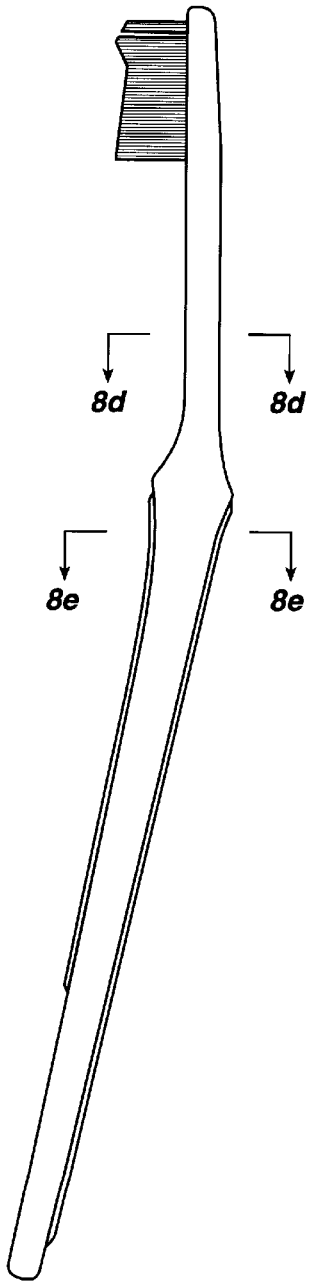
Figure 7C:
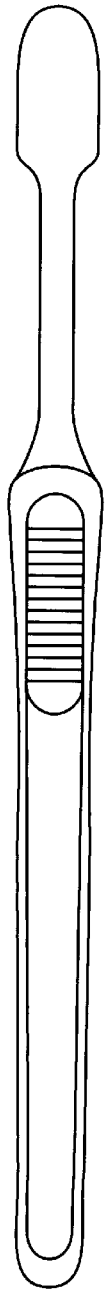
Figure 8C:
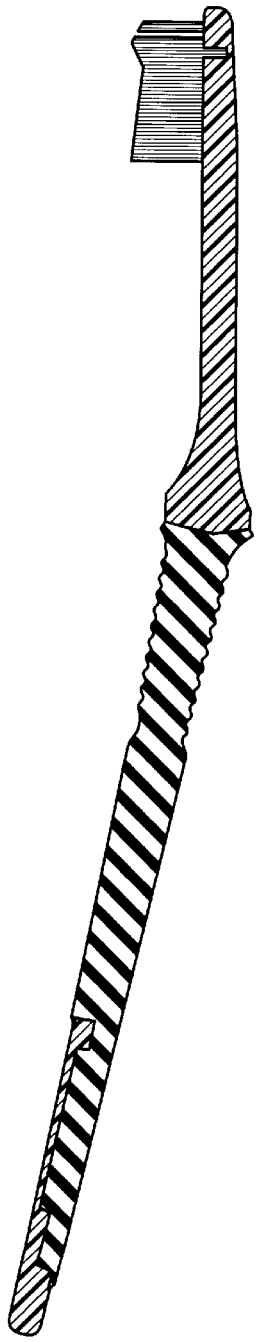
FIG. 8(*a*) is a front elevational view of the toothbrush of FIG. 7(*a*)
Figure 8A:
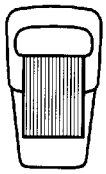
Figure 8D:
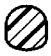
Figure 8B:
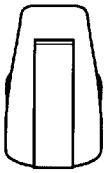
Figure 8E:
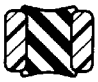

The first, second and third brush surfaces are designated by numerals 1, 2 and 3, respectively. Numeral 5 designates the bristle tufts of bristle row 32 which is nearest to the brush neck 12. Numeral 6 designates the first bristle peak. Numeral 7 designates the second bristle peak. Numeral 22 designates the bristle valley. Letter A designates the length of first brush surface 1, B designates the length of second brush surface 2, C designates the length of third brush surface 3, D designates the length of the entire bristle section. It will be understood that lengths A, B, C and D are measured in a direction parallel to the longitudinal axis of the brush head of the toothbrush. E designates the bristle height at the first peak 6; F designates the bristle height at bristle valley 22; G designates the brush head length; H designates the brush head width; I designates the maximum width of the handle; J designates the width of the neck portion; K designates the thickness of the neck portion; L designates the entire length of the toothbrush blank as shown in FIG. 6(*b*).

What is claimed is:

1. A toothbrush comprising a brush head, a handle and a neck portion connecting said brush head to said handle, said brush head having a free end distal from said handle and an attached end adjacent to said neck portion, wherein;

a) said brush comprises a plurality of rows of bristle tufts, each of said rows of bristle tufts being oriented in a direction generally perpendicular to a longitudinal axis of said toothbrush;

b) the tips of the bristles of said bristle tufts being arranged to provide three brush surfaces;

c) the first of said three brush surfaces being located adjacent the free end of said brush head and extending upwardly from said free end at an angle of from about 15° to about 45° with respect to said brush head to a first bristle peak;

d) said second brush surface extending downwardly from said first bristle peak toward said brush head at an angle of from about 15° to about 45° with respect to said brush head;

e) said third brush surface extending upwardly from said second brush surface, at an angle of from about 5° to about 25° with respect to said brush head, to a second bristle peak adjacent said neck portion, said second brush surface and said third brush surface forming a bristle valley located below said first bristle peak and said second bristle peak;

f) the ratio of the height of the bristles at said first bristle peak to the height of the bristles located at said bristle valley being from about 1.1 to about 1.4; and, g) the difference between the height of the bristles at said second bristle peak and the height of said bristles at said first peak being less than about 2 mm;

wherein all of the tips of the bristles in at least one of said second brush surface and said third brush surface is planar form a plane.

2. The toothbrush of claim 1 wherein said brush head comprises six to ten rows of bristle tufts.

3. The toothbrush of claim 1 wherein said first bristle peak is located at the top of the second row of bristle tufts from said free end of said brush head.

4. The toothbrush of claim 1 wherein said bristle valley is located at the third to the fifth row of bristle tufts from said free end of said brush head.

5. The toothbrush of claim 1 wherein said brush head comprises six to ten rows of bristle tufts, said first bristle peak is located at the top of the second row of bristle tufts from said free end of said brush head, and wherein said bristle valley is located at the third to the fifth row of bristle tufts from said free end of said brush head.

6. The toothbrush according to claim 1 characterized in that the bristles of said first peak and those of said second peak are of substantially the same height.

7. The toothbrush according to claim 1 characterized in that the difference in bristle heights between the valley and the first peak as well as the difference in bristle height between the valley and the second peak are both from about 0.3 mm to about 6 mm.

8. The toothbrush according to claim 1 characterized in that the differences in bristle height between the valley and the first peak as well as between the valley and the second peak are both from about 1.5 mm to about 3 mm.

9. The toothbrush according to claim 1 characterized in that the bristles comprising the first row and the second row of bristle tufts from said free end of said brush head and the row of bristle tufts adjacent said neck portion are stiffer than the rest of the bristles.

10. The toothbrush according to claim 9 characterized in that the color of said stiffer bristles is different from that of the other bristles.

11. The toothbrush according to claim 1 characterized in that the bristles comprising the first row and the second row of bristle tufts from said free end of said brush head and the row of bristle tufts adjacent said attached end of said brush head are thicker than the rest of the bristles.

12. The toothbrush according to claim 11 characterized in that the color of said thicker bristles is different from that of the other bristles.

13. The toothbrush according to claim 1 characterized in that said first brush surface and said second brush surface are symmetrically disposed about a plane which bisects said first peak.

14. The toothbrush according to claim 1 characterized in that said third brush surface is longer than one half a length of a bristle section of the brush head.

15. The toothbrush of claim 1 wherein said first bristle peak is located at the top of the third row of bristle tufts from said free end of said brush head.

16. The toothbrush of claim 1 wherein said brush head comprises six to ten rows of bristle tufts, said first bristle peak is located at the top of the third row of bristle tufts from said free end of said brush head, and wherein said bristle valley is located at the third to the fifth row of bristle tufts from said free end of said brush head.

17. The toothbrush according to claim 1 characterized in that the bristles comprising the first row to the third row of bristle tufts from said free end of said brush head and the row of bristle tufts adjacent said neck portion are stiffer than the rest of the bristles.

18. The toothbrush according to claim 1 characterized in that the bristles comprising the first row to the third row of bristle tufts from said free end of said brush head and the row of bristle tufts adjacent said attached end of said brush head are thicker than the rest of the bristles.

19. A toothbrush comprising a brush head, a handle and a neck portion connecting said brush head to said handle, said brush head having a free end distal from said handle and an attached end adjacent to said neck portion, wherein;

a) said brush comprises a plurality of rows of bristle tufts, each of said rows of bristle tufts being oriented in a direction generally perpendicular to a longitudinal axis of said toothbrush;

b) the tips of the bristles of said bristle tufts being arranged to provide three brush surfaces;

c) the first of said three brush surfaces being located adjacent the free end of said brush head and extending upwardly from said free end at an angle of from about 15° to about 45° with respect to said brush head to a first bristle peak;

d) said second brush surface extending downwardly from said first bristle peak toward said brush head at an angle of from about 15° to about 45° with respect to said brush head;

e) said third brush surface extending upwardly from said second brush surface, at an angle of from about 5° to about 25° with respect to said brush head, to a second bristle peak adjacent said neck portion, said second brush surface and said third brush surface forming a bristle valley located below said first bristle peak and said second bristle peak;

f) the ratio of the height of the bristles at said first bristle peak to the height of the bristles located at said bristle valley being from about 1.1 to about 1.4; and, g) the difference between the height of the bristles at said second bristle peak and the height of said bristles at said first peak being less than about 2 mm;

wherein the bristles comprising the first row and the second row of bristle tufts from said free end of said brush head and the row of bristle tufts adjacent said neck portion are stiffer than the rest of the bristles.

20. The toothbrush according to claim 19 characterized in that the color of said stiffer bristles is different from that of the other bristles.

21. A toothbrush comprising a brush head, a handle and a neck portion connecting said brush head to said handle, said brush head having a free end distal from said handle and an attached end adjacent to said neck portion, wherein;

a) said brush comprises a plurality of rows of bristle tufts, each of said rows of bristle tufts being oriented in a direction generally perpendicular to a longitudinal axis of said toothbrush;

b) the tips of the bristles of said bristle tufts being arranged to provide three brush surfaces;

c) the first of said three brush surfaces being located adjacent the free end of said brush head and extending upwardly from said free end at an angle of from about 15° to about 45° with respect to said brush head to a first bristle peak;

d) said second brush surface extending downwardly from said first bristle peak toward said brush head at an angle of from about 15° to about 45° with respect to said brush head;

e) said third brush surface extending upwardly from said second brush surface, at an angle of from about 5° to about 25° with respect to said brush head, to a second bristle peak adjacent said neck portion, said second brush surface and said third brush surface forming a bristle valley located below said first bristle peak and said second bristle peak;

f) the ratio of the height of the bristles at said first bristle peak to the height of the bristles located at said bristle valley being from about 1.1 to about 1.4; and, g) the difference between the height of the bristles at said second bristle peak and the height of said bristles at said first peak being less than about 2 mm;

wherein the bristles comprising the first row to the third row of bristle tufts from said free end of said brush head and the row of bristle tufts adjacent said neck portion are stiffer than the rest of the bristles.

22. The toothbrush according to claim 21 characterized in that the color of said stiffer bristles is different from that of the other bristles.

23. A toothbrush comprising a brush head, a handle and a neck portion connecting said brush head to said handle, said brush head having a free end distal from said handle and an attached end adjacent to said neck portion, wherein;

a) said brush comprises a plurality of rows of bristle tufts, each of said rows of bristle tufts being oriented in a direction generally perpendicular to a longitudinal axis of said toothbrush;

b) the tips of the bristles of said bristle tufts being arranged to provide three brush surfaces;

c) the first of said three brush surfaces being located adjacent the free end of said brush head and extending upwardly from said free end at an angle of from about 15° to about 45° with respect to said brush head to a first bristle peak;

d) said second brush surface extending downwardly from said first bristle peak toward said brush head at an angle of from about 15° to about 45° with respect to said brush head;

e) said third brush surface extending upwardly from said second brush surface, at an angle of from about 5° to about 25° with respect to said brush head, to a second bristle peak adjacent said neck portion, said second brush surface and said third brush surface forming a bristle valley located below said first bristle peak and said second bristle peak;

f) the ratio of the height of the bristles at said first bristle peak to the height of the bristles located at said bristle valley being from about 1.1 to about 1.4; and, g) the difference between the height of the bristles at said second bristle peak and the height of said bristles at said first peak being less than about 2 mm;

wherein the bristles comprising the first row and the second row of bristle tufts from said free end of said brush head and the row of bristle tufts adjacent said attached end of said brush head are thicker than the rest of the bristles.

24. The toothbrush according to claim 23 characterized in that the color of said thicker bristles is different from that of the other bristles.

25. A toothbrush comprising a brush head, a handle and a neck portion connecting said brush head to said handle, said brush head having a free end distal from said handle and an attached end adjacent to said neck portion, wherein;

a) said brush comprises a plurality of rows of bristle tufts, each of said rows of bristle tufts being oriented in a direction generally perpendicular to a longitudinal axis of said toothbrush;

b) the tips of the bristles of said bristle tufts being arranged to provide three brush surfaces;

c) the first of said three brush surfaces being located adjacent the free end of said brush head and extending upwardly from said free end at an angle of from about 15° to about 45° with respect to said brush head to a first bristle peak;

d) said second brush surface extending downwardly from said first bristle peak toward said brush head at an angle of from about 15° to about 45° with respect to said brush head;

e) said third brush surface extending upwardly from said second brush surface, at an angle of from about 5° to about 25° with respect to said brush head, to a second bristle peak adjacent said neck portion, said second brush surface and said third brush surface forming a bristle valley located below said first bristle peak and said second bristle peak;

f) the ratio of the height of the bristles at said first bristle peak to the height of the bristles located at said bristle valley being from about 1.1 to about 1.4; and, g) the difference between the height of the bristles at said second bristle peak and the height of said bristles at said first peak being less than about 2 mm;

wherein the bristles comprising the first row to the third row of bristle tufts from said free end of said brush head and the row of bristle tufts adjacent said attached end of said brush head are thicker than the rest of the bristles.

26. The toothbrush according to claim 25 characterized in that the color of said thicker bristles is different from that of the other bristles.

* * * * *